US010378522B2

(12) United States Patent
Smith

(10) Patent No.: US 10,378,522 B2
(45) Date of Patent: Aug. 13, 2019

(54) PISTON PUMP WITH BARRIER FLUID SEAL

(71) Applicant: CDI Energy Products, Inc., Humble, TX (US)

(72) Inventor: Stephen Earl Smith, League City, TX (US)

(73) Assignee: CDI ENERGY PRODUCTS, INC., Humble, TX (US)

( * ) Notice: Subject to any disclaimer, the term of this patent is extended or adjusted under 35 U.S.C. 154(b) by 399 days.

(21) Appl. No.: 14/603,639

(22) Filed: Jan. 23, 2015

(65) Prior Publication Data

US 2015/0204316 A1 Jul. 23, 2015

Related U.S. Application Data

(60) Provisional application No. 61/930,632, filed on Jan. 23, 2014.

(51) Int. Cl.

| | |
|---|---|
| ***F04B 1/04*** | (2006.01) |
| ***F04B 53/02*** | (2006.01) |
| ***F04B 53/14*** | (2006.01) |
| ***F04B 53/16*** | (2006.01) |

(52) U.S. Cl.

CPC ..... *F04B 1/0448* (2013.01); *F04B 53/02* (2013.01); *F04B 53/143* (2013.01); *F04B 53/162* (2013.01)

(58) Field of Classification Search

CPC ..... F04B 1/0448; F04B 1/122; F04B 15/00; F04B 15/02; F04B 27/0821; F04B 27/0873; F04B 27/1036; F04B 39/041; F04B 39/042; F04B 39/045; F04B 53/02; F04B 53/143; F04B 53/146; F04B 53/147; F04B 53/16; F04B 53/162; F16J 15/56; F16J 15/444

See application file for complete search history.

(56) References Cited

U.S. PATENT DOCUMENTS

| | | | | | |
|---|---|---|---|---|---|
| 2,589,332 | A * | 3/1952 | Brown | F16J 15/56 | 277/341 |
| 3,019,739 | A * | 2/1962 | Prosser | F04B 53/14 | 184/6.16 |
| 4,174,929 | A * | 11/1979 | Grakov | F04B 53/164 | 277/558 |
| 5,456,475 | A * | 10/1995 | Abraham | B01D 33/801 | 210/171 |
| 6,883,649 | B2 * | 4/2005 | Lun | F16F 9/3242 | 188/267 |

* cited by examiner

*Primary Examiner* — Bryan M Lettman
*Assistant Examiner* — Charles W Nichols
(74) *Attorney, Agent, or Firm* — Michael E. Dockins; Shumaker, Loop & Kendrick, LLP

(57) ABSTRACT

A piston pump including a cylinder body having an internal fluid chamber, a piston configured to axially cycle within the cylinder body, an inlet valve, an outlet valve, an annular seal positioned between the piston and cylinder body, a barrier fluid pocket formed in the cylinder body adjacent one end of the annular seal, and a barrier fluid contained within the barrier fluid pocket, the barrier fluid preventing suspended solids in pumped fluid from contacting the annular seal.

8 Claims, 8 Drawing Sheets

PISTON PUMP WITH BARRIER FLUID SEAL

CROSS-REFERENCE TO RELATED APPLICATION

This application claims priority from U.S. Patent Application No. 61/930,632 filed Jan. 23, 2014, the entirety of which is incorporated by reference herein.

TECHNICAL FIELD AND BACKGROUND OF THE INVENTION

The present invention relates generally to the field of reciprocating pumps, and more particularly, to a vertical pump that utilizes a stagnant fluid pocket adjacent the piston seal to prevent drilling fluid containing suspended solids from reaching and abrading the seal.

Reciprocating piston pumps are commonly used in drilling applications to extract dense fluid containing suspended solids such as sand, ceramic grit, cement and other debris. Known to those skilled in the art, reciprocating piston pumps are displacement pumps generally including a piston, cylinder, inlet valve and outlet valve. Pumps may include more than one cylinder, and in oil and gas drilling applications, typically include three or four cylinders. During the downstroke or "suction phase," the inlet valve opens and the outlet valve closes to allow fluid to enter the pump. During the upstroke or "discharge phase," the inlet valve closes and the outlet valve opens to force fluid from the pump.

Pumps used in drilling applications are required to pump dense fluid over long distances, and therefore operate at pressures up to about 22,000 psi, more commonly from about 10,000-12,000 psi. High pressure causes wear on the pump components, particularly the piston, cylinder and piston seal or "service packing." The service packing, which is the annular seal disposed tightly between the reciprocating piston and the cylinder wall, is typically constructed from one or more of elastomeric, metal and plastic components. As the piston cycles axially within the cylinder and service packing, pumped fluid containing suspended solids comes into direct contact with the high pressure end of the packing, abrading the packing and consequently degrading the performance of the seal. Worn seals must be replaced on a regular basis, leading to frequent servicing, increased cost and pump downtime.

Accordingly, what is needed is a seal that prevents service packing failure as a result of abrasive wear.

BRIEF SUMMARY OF THE INVENTION

It is an object of the invention to provide a piston pump having a fluid barrier seal for preventing suspended solids in pumped fluid from contacting and abrading the pump seal.

It is another object of the invention to provide a piston pump having a fluid barrier seal containing a volume of barrier fluid having a predetermined specific gravity greater or less than a specific gravity of suspended solids in pumped fluid, dependent upon pump orientation, to prevent the suspended solids from passing the barrier fluid and reaching a pump seal.

To achieve the foregoing and other objects and advantages, provided herein is a piston pump including a cylinder body having an internal fluid chamber, a piston configured to axially cycle within the cylinder body, an inlet valve in fluid communication with the fluid chamber, an outlet valve in fluid communication with the fluid chamber, an annular seal positioned between the piston and the cylinder body, a barrier fluid pocket formed in the cylinder body adjacent one end of the annular seal, and a barrier fluid contained within the barrier fluid pocket, the barrier fluid preventing suspended solids in pumped fluid from contacting the annular seal.

In a further embodiment, the barrier fluid pocket may be formed adjacent a high-pressure side of the annular seal facing in a direction of the fluid chamber of the cylinder body.

In a further embodiment, the piston pump may include a lattice structure positioned within the barrier fluid pocket, the lattice structure defining at least one barrier fluid pathway therethrough.

In a further embodiment, the lattice structure may be an annular structure having a repeating series of geometric shapes having a constant cross-section from a top to a bottom of the lattice structure.

In a further embodiment, the geometric shapes may be one or more of honeycomb, circular, triangular and square.

In a further embodiment, the barrier fluid pocket may include a first portion having a constant cross-section containing the lattice structure and a second portion tapering radially inward in a direction of the fluid chamber of the cylinder body.

In a further embodiment, the lattice structure may include a stack of spaced, laterally-offset, adjacent annular rings.

In a further embodiment, the lattice structure may include a stack of spaced, laterally-offset annular rings sandwiched between two layers of two-dimensional lattice structure.

In a further embodiment, the lattice structure may be an annular structure positioned in close fit around the piston, the annular structure including a honeycomb lattice portion positioned adjacent the piston and a solid portion positioned apart from the piston.

In a further embodiment, the barrier fluid includes one or more of naphtha, automotive crank oil, automotive gear oil, cod oil, corn oil, diesel fuel, fuel oil, industrial turbine oil, kerosene, and fluids having a specific gravity less than 4.

In a further embodiment, the barrier fluid includes one or more of bromine, a magnetite/alcohol liquid-solid suspension, a liquid/salt solution including water, oil or alcohol with zinc, bromide, cesium bromide or cesium fluoride, and fluids having a specific gravity greater than or equal to 4.

In a further embodiment, the annular seal may be single or multi-element service packing including one or more of elastomeric materials, metals, plastic rings and back-ups.

According to another embodiment of the invention, the present invention provides a piston pump having a barrier fluid seal, the piston pump including a cylinder body having an internal fluid chamber, a piston configured to axially cycle within the cylinder body, an inlet valve, an outlet valve, an annular seal positioned between the piston and cylinder body, a barrier fluid pocket formed in the cylinder body adjacent one end of the annular seal, a barrier fluid contained within the barrier fluid pocket, and lattice structure positioned within the barrier fluid pocket defining at least one barrier fluid pathway therethrough.

Embodiments of the invention can include one or more or any combination of the above features, aspects and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as claimed. The accompanying drawings are included to provide a further understanding of the invention, and are incorporated in and constitute a part of this specification.

BRIEF DESCRIPTION OF THE DRAWINGS

Features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
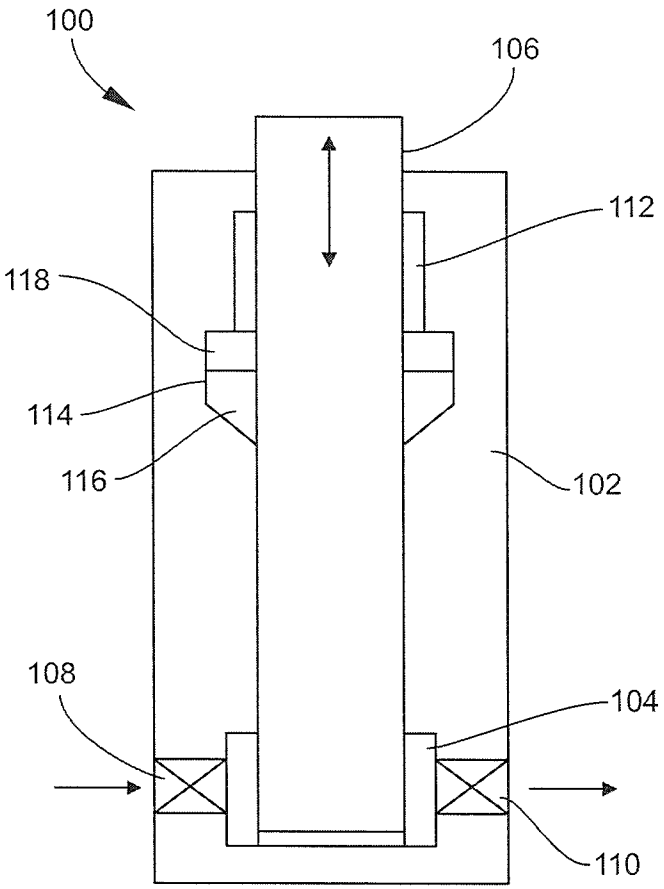
FIG. 1 is a schematic illustration of a piston pump utilizing a "light" fluid barrier according to an embodiment of the invention.
Figure 3:
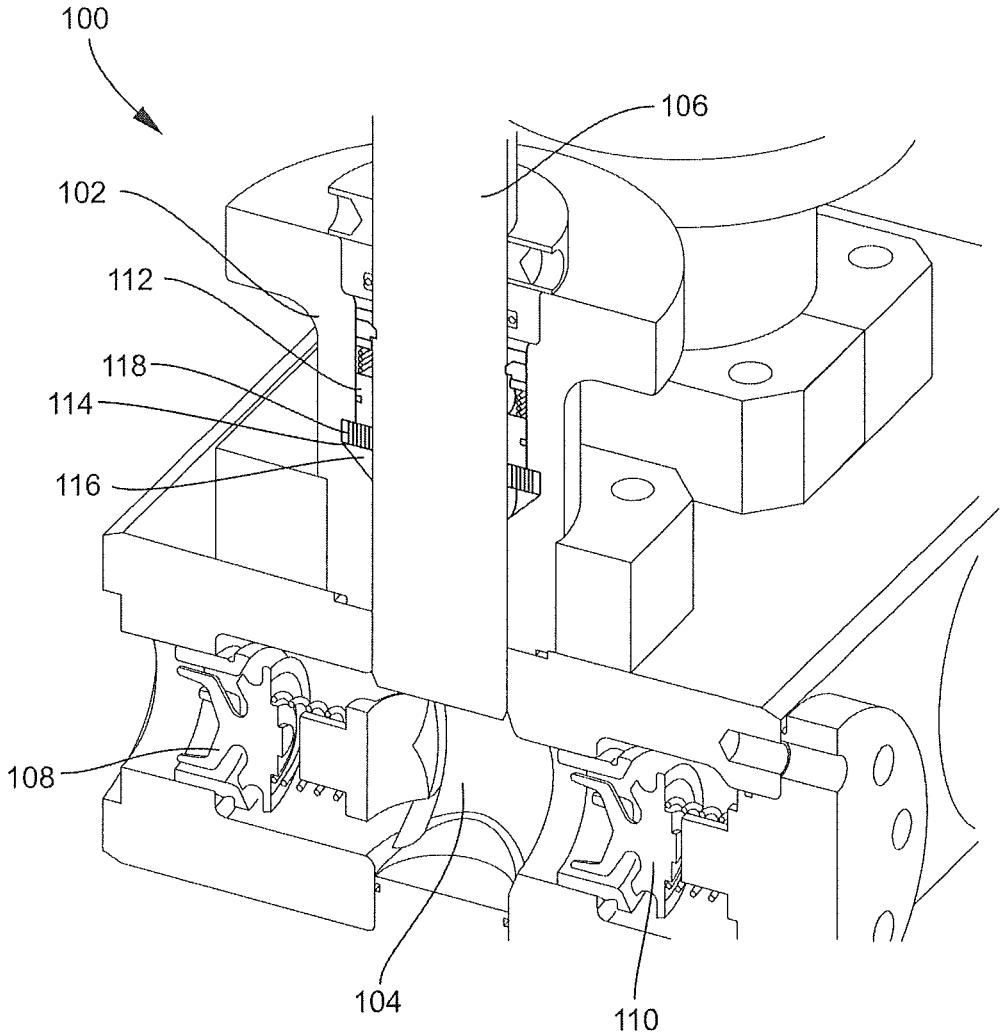
FIG. 3 is a cross-sectional view through a piston pump utilizing a light fluid barrier according to the present invention.

Referring to FIGS. 1 and 3, a piston pump according to a first embodiment of the invention is shown at reference numeral 100. FIG. 1 shows the piston pump 100 schematically, while FIG. 3 shows a portion of an exemplary piston pump in cross-section. Piston pump 100 generally includes a cylinder body 102 having an internal fluid chamber 104, a piston 106 configured to axially cycle within the cylinder body, an inlet valve 108 in fluid communication with the fluid chamber, an outlet valve 110 in fluid communication with the fluid chamber, and an annular seal 112 in the form of service packing. During the upstroke or "suction phase" of the pump 100, the outlet valve 110 closes and the inlet valve 108 opens to draw pumped fluid containing suspended solids into the cylinder body 102 through the inlet valve. During the downstroke or "discharge phase" of the pump, the inlet valve 108 closes and the outlet valve 110 opens to force the pumped fluid in the cylinder body 102 out through the outlet valve.

The annular seal 112 forms a seal between the piston 106 and the interior wall of the cylinder body 102 and creates an area of high pressure within the pump. A pressure drop exists across the annular seal 112 from the high pressure side to the atmospheric pressure side. Known to those skilled in the art, service packing generally functions to seal an annulus, and in the particular application shown, seals the annulus between the reciprocating piston 106 and the cylinder body wall. Conventional packing types suitable for use in the present invention may include, but are not limited to, single and multi-element packers including one or more of elastomeric materials, metals, plastic rings and back-ups.

The piston axis is oriented vertically and the annular seal 112 is positioned vertically above the inlet and outlet valves 108, 110. In this vertical arrangement, an annular barrier fluid pocket 114 is formed immediately vertically below the high-pressure side of the annular seal 112. The barrier fluid pocket 114 contains a predetermined barrier fluid 116 maintained within an annular lattice structure 118 that functions to prevent the pumped fluid containing suspended solids from contacting the high-pressure side of the annular seal 112, thereby protecting the annular seal from abrasion and extending the life of the seal.

The barrier fluid pocket 114 retains the barrier fluid 116 in position during normal pumping action of the piston 106. In the pump shown, the barrier fluid 116 is a "light" fluid in comparison to the pumped fluid, meaning that the specific gravity of the barrier fluid is less than the specific gravity of the pumped fluid, thereby causing the barrier fluid to "float," making it difficult for the solids in the pumped fluid to migrate up through the stagnant barrier fluid to the annular seal 112. For example, a suspended solid such as sand has a specific gravity of about 2.6, thus in applications in which the pumped fluid contains suspended sand the barrier fluid would have a specific gravity less than 2.6.

Suitable examples of "light" barrier fluids (i.e., fluids having a low specific gravity as compared to the pumped fluid containing suspended solids) include, but are not limited to, naphtha, automotive crank oils (e.g., SAE 10W, 20W, etc.), automotive gear oils (e.g., SAE 75W, 90W, etc.), cod oil, corn oil, diesel fuel, fuel oils, industrial turbine oils (e.g., 150 SSU, 420 SSU, etc.), kerosene, fluids having a specific gravity less than 4, etc. Preferable light fluids will not mix chemically or become absorbed into the pumped fluid. Preferable light fluids will act as a lubricating fluid for the piston 106 and annular seal 112. Preferable light fluids are suitable for use under typical operating temperatures in the range from −50° F. to 350° F. Other factors for selecting an appropriate barrier fluid may include magnetic properties, fluid surface tension, vapor pressure, etc. Preferable light fluids allow substantially frictionless piston travel with no increase in power requirements.

Figure 2:
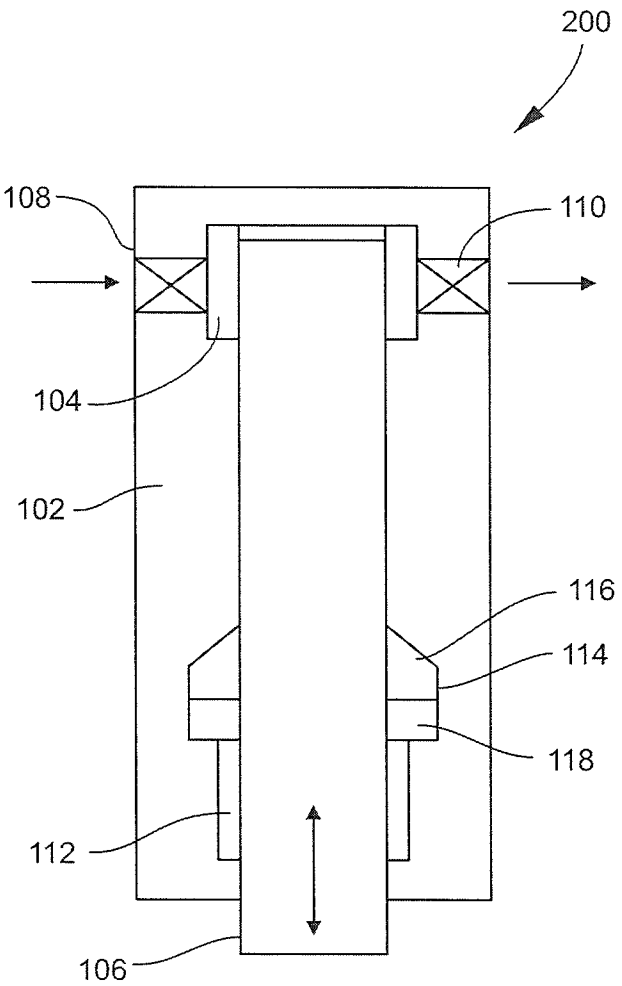
FIG. 2 is a schematic illustration of a piston pump utilizing a "heavy" fluid barrier according to an embodiment of the invention.
Figure 4:
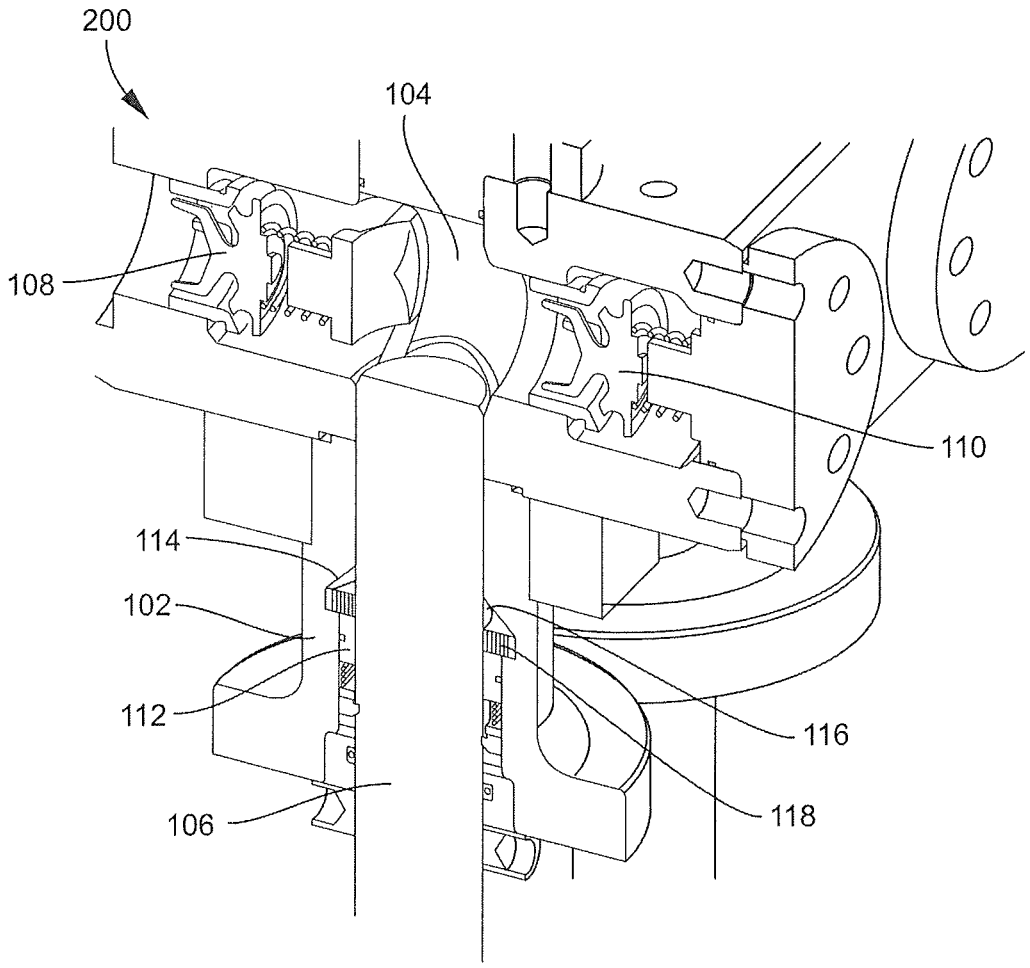
FIG. 4 is a cross-sectional view through a piston pump utilizing a heavy fluid barrier according to the present invention.

Referring to FIGS. 2 and 4, a piston pump according to a second embodiment of the invention is shown generally at reference numeral 200. FIG. 2 shows the piston pump 200 schematically, while FIG. 4 shows a portion of an exemplary piston pump in cross-section. Like piston pump 100, piston pump 200 generally includes a cylinder body 102 having an internal fluid chamber 104, a reciprocating piston 106, an inlet valve 108, an outlet valve 110, and an annular seal 112. Due to the inverted orientation as compared to piston pump 100, fluid containing suspended solids is drawn in through the inlet valve 108 during the downstroke or "suction phase," and forced out through the outlet valve 110 during the upstroke or "discharge phase."

The annular seal 112, which may also be in the form of service packing, is positioned vertically below the inlet and outlet valves 108 and 110 and creates an area of high pressure within the pump. In the vertical arrangement shown, the annular barrier fluid pocket 114 is formed immediately vertically above the high-pressure side of the annular seal 112. The barrier fluid pocket 114 contains a predetermined barrier fluid 116 maintained within an annular lattice structure 118 that functions to prevent the pumped fluid containing suspended solids from falling into contact with the high-pressure side of the annular seal 112. In the pump shown, the barrier fluid 116 is a "heavy" fluid in comparison to the pumped fluid, meaning that the specific gravity of the barrier fluid is greater than the specific gravity of the pumped fluid, thereby causing the barrier fluid to "sink," making it difficult for the solids in the pumped fluid to migrate down through the barrier fluid to the annular seal 112.

Suitable examples of "heavy" barrier fluids (i.e., fluids having a high specific gravity as compared to the pumped fluid) include, but are not limited to, bromine, liquid-solid suspensions such as magnetite/alcohol, various liquid/salt solutions including water, oil or alcohol with zinc, bromide, cesium bromide or cesium fluoride, fluids having a specific gravity greater than or equal to 4, etc. Preferable heavy fluids will not mix chemically or become absorbed into the pumped fluid, will act as a lubricating fluid for the piston 106 and annular seal 112, and are suitable for use under typical operating temperatures in the range from −50° F. to 350° F. Other factors for determining a suitable heavy fluid may include magnetic properties, fluid surface tension, vapor pressure, etc. Preferable heavy fluids allow substantially frictionless piston travel with no increase in power requirements.

In either pump configuration 100 or 200, the barrier fluid 116 functions to prevent solids from reaching and abrading the seal, and is held in position in a substantially stagnant condition during normal pumping action of the piston 106. The barrier fluid 116 may be stabilized and entrapped around the seal by incorporating a lattice structure 118 into the barrier fluid pocket 114. The lattice structure 118 may be positioned within the barrier fluid pocket 114 immediately adjacent the high-pressure side of the annular seal 112. The lattice structure 118 generally defines open flow pathways therethrough for the entrapped barrier fluid 116 to flow between the top and bottom of the lattice structure, wherein the top of the lattice structure represent a first end thereof and the bottom of the lattice structure represents an opposing second end thereof. The open flow pathways extend longitudinally through the lattice structure 118 in a direction parallel to the axial direction of the piston 106. A first end of each of the flow pathways faces towards the internal fluid chamber 104 and an opposing second end of each of the flow pathways faces towards the annular seal 112. Suitable lattice materials include, but are not limited to, plastics and metals. In a particular embodiment, barrier fluids and lattice materials may have magnetic properties to help retain the barrier fluid in place with the lattice.

Figure 5:
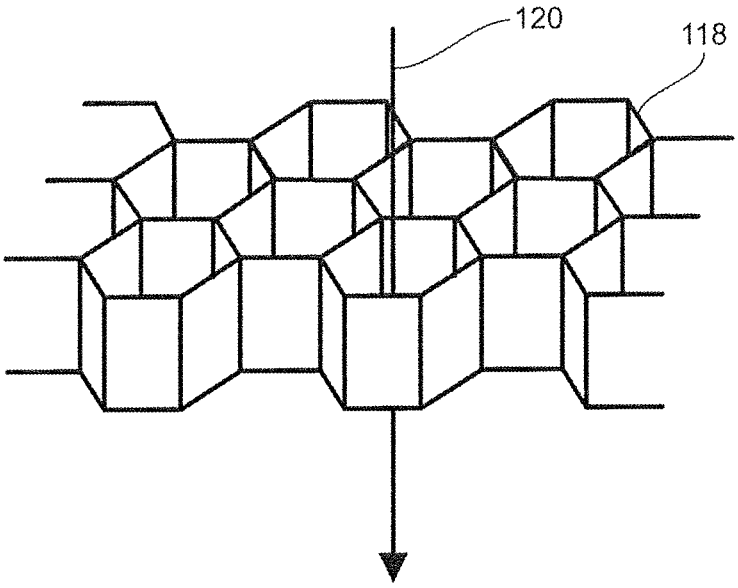
FIG. 5 is a schematic drawing illustrating the open flow path through honeycomb lattice.
Figure 7:
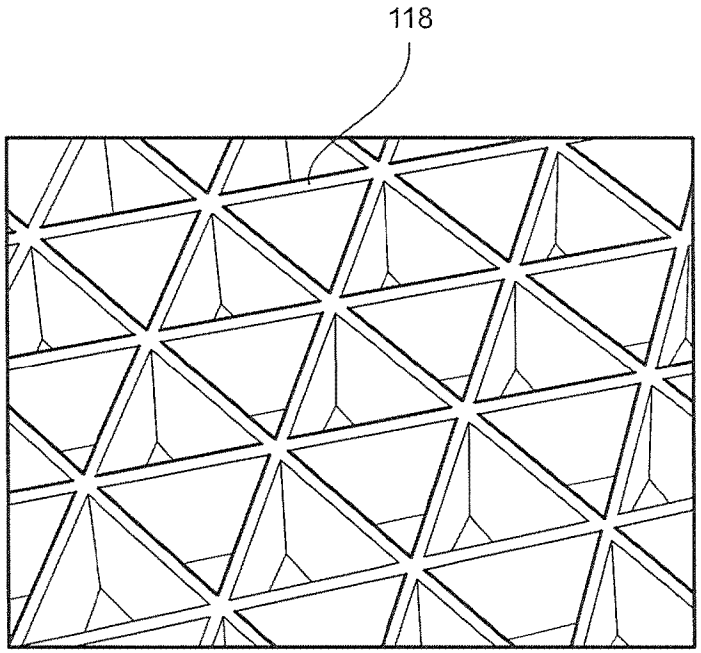
FIG. 7 is a schematic drawing of triangular lattice.
Figure 6:
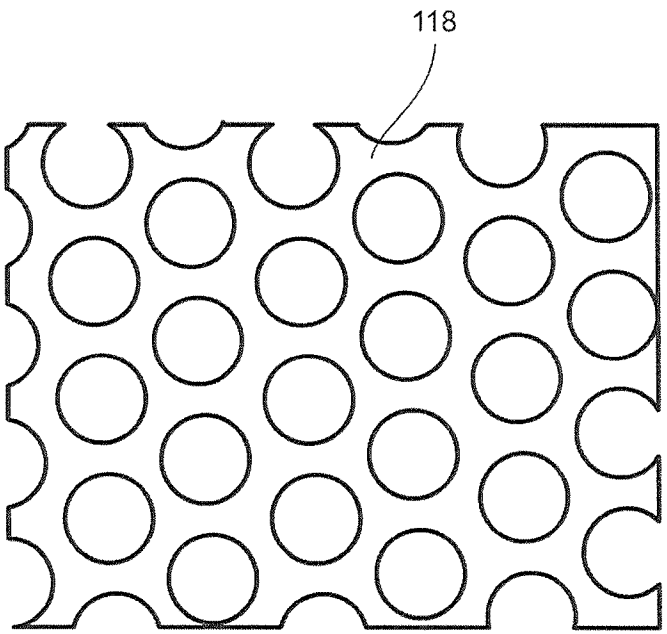
FIG. 6 is a schematic drawing of round lattice.
Figure 9:
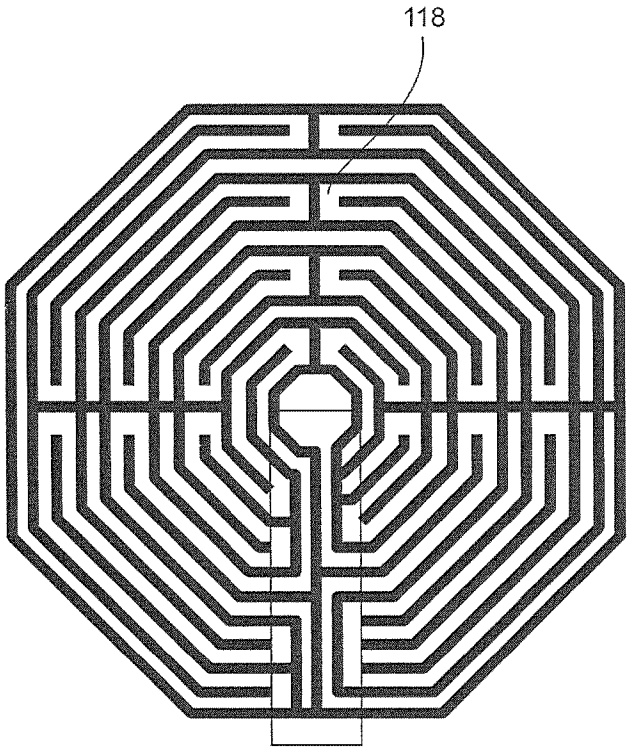
FIG. 9 is a schematic drawing of geometric lattice.
Figure 8:
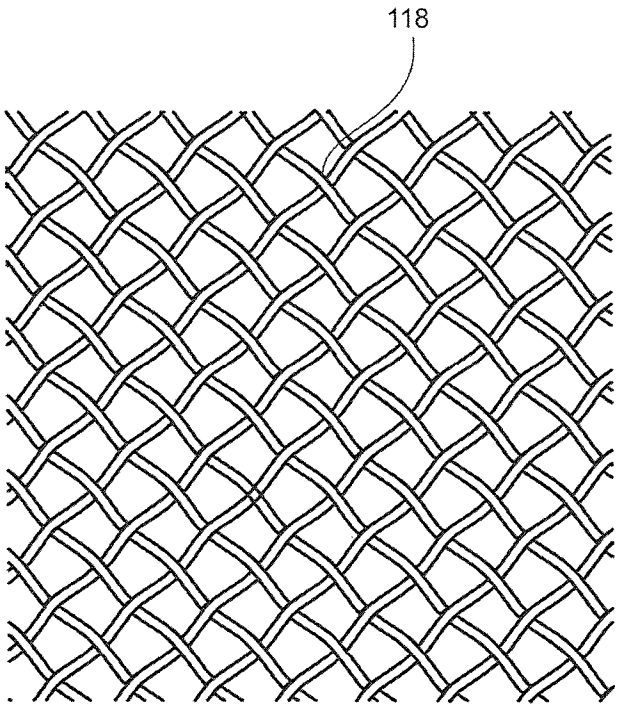
FIG. 8 is a schematic drawing of square lattice constructed from interwoven strips.

FIGS. 5-9 illustrate suitable examples of two-dimensional (2D) lattice structures for use in the present invention. These lattice structures may be in the form of an annular structure generally including repeating series of geometric shapes having a constant cross-section from top to bottom, thereby defining linear flow pathways therethrough indicated at directional arrow 120 in FIG. 5, wherein the directional arrow 120 is arranged parallel to the axial direction of the piston 106. Geometric shapes may include, but are not limited to, honeycomb as shown in FIG. 5, circular as shown in FIG. 6, triangular as shown in FIG. 7, square as shown in the woven lattice of FIG. 8, and complex geometric patterns as shown in the lattice of FIG. 9.

Figure 11:
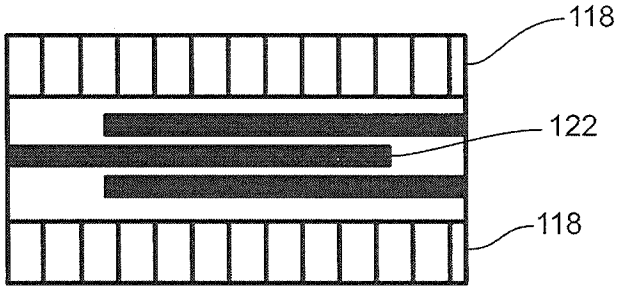
FIG. 11 schematically illustrates three-dimensional multi-stage lattice.
Figure 10:
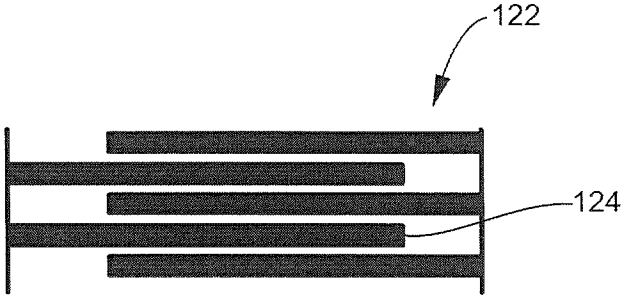
FIG. 10 schematically illustrates multi-stage axial lattice.
Figure 12:
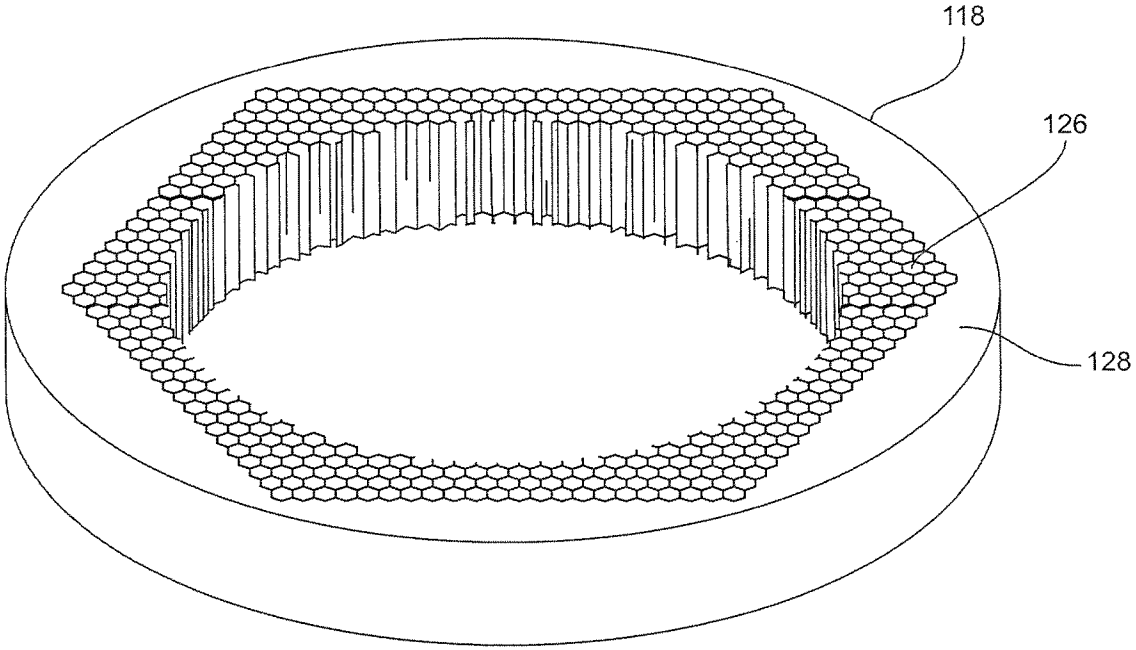
FIG. 12 is an isometric view of annular lattice configured to closely fit around a reciprocating piston.

Three-dimensional (3D) lattice structures may also be utilized. Three-dimensional lattice structures may be formed into annular rings generally including repeating geometric shapes having a random or repeating cross-section from top to bottom. Three-dimensionality can be accomplished by providing a plurality of layers of axial lattice in which adjacent layers are offset (i.e., layers above and below), or where baffles are present. FIG. 10 illustrates one example of multi-stage axial lattice 122 having a plurality of axial lattice layers 124 stacked vertically with space therebetween and adjacent layers offset. FIG. 11 illustrates one example of multi-stage lattice including a layer of axial lattice 122 sandwiched between two layers of two-dimensional lattice structure 118. In the lattice structures shown in FIGS. 10 and 11, the flow pathways from top to bottom may be non-linear. FIG. 12 illustrates a specific annular lattice structure 118 that fits closely around the piston, wherein an interior portion 126 adjacent the piston includes honeycomb lattice and the exterior portion 128 spaced from the piston is solid, viewed in the radial direction. As shown in FIG. 12, each of the flow pathways formed through the interior portion 126 of the lattice structure 118 extends parallel to the axial direction of the piston 106 surrounded by the lattice structure 118.

The barrier fluid pocket 114 may have a constant cross-section from top to bottom, may taper in either direction, or may include a combination of both. As best shown in FIGS. 1-4, a portion of the barrier fluid pocket 114 immediately forward of the annular seal 112 may have a constant cross-section to accommodate the annular lattice structure 118, and thereafter tapers radially inward in the direction away from the annular seal 112. This shape, in combination with a lattice structure 118, helps to prevent axial turbulence in the barrier fluid 116 during pump operation.

The foregoing description provides embodiments of the invention by way of example only. It is envisioned that other embodiments may perform similar functions and/or achieve similar results. Any and all such equivalent embodiments and examples are within the scope of the present invention.

What is claimed is:

1. A piston pump, comprising:

a cylinder body having an internal fluid chamber;

a piston configured to axially cycle within the cylinder body;

an inlet valve in fluid communication with the fluid chamber;

an outlet valve in fluid communication with the fluid chamber;

a fixed annular seal positioned between the piston and the cylinder body;

a barrier fluid pocket formed in the cylinder body directly adjacent a high-pressure side of the annular seal, the barrier fluid pocket containing a lattice structure, wherein the lattice structure extends axially from a first end to a second end thereof, the first end of the lattice structure abutting the high-pressure side of the annular seal, wherein the lattice structure includes a plurality of barrier fluid pathways defined therethrough, wherein each of the barrier fluid pathways extends linearly and longitudinally through the lattice structure from the first end thereof to the second end thereof in a direction parallel to an axial direction of the piston, wherein a first end of each of the barrier fluid pathways faces towards the high-pressure side of the annular seal, and wherein the first end of each of the barrier fluid pathways is formed at the first end of the lattice structure;

a barrier fluid contained within the barrier fluid pocket, the barrier fluid being different from a pumped fluid and preventing suspended solids in the pumped fluid from contacting the annular seal, and wherein the barrier fluid pocket comprises a first portion having a constant cross-section containing the lattice structure and the barrier fluid pocket ending in a second portion tapering radially inward in a direction of the fluid chamber of the cylinder body.

2. The piston pump of claim 1, wherein the barrier fluid pocket faces in a direction of the fluid chamber of the cylinder body.

3. The piston pump of claim 1, wherein the lattice structure is an annular structure comprising a repeating series of geometric shapes having a constant cross-section from a first end to a second end of the lattice structure.

4. The piston pump of claim 1, wherein the lattice structure is an annular structure positioned in close fit around the piston, the annular structure including a honeycomb lattice portion positioned adjacent the piston and a solid portion positioned apart from the piston.

5. The piston pump of claim 1, wherein the annular seal is single or multi-element service packing including one or more of elastomeric materials, metals, plastic rings and back-ups.

6. A piston pump having a barrier fluid seal, comprising:

a cylinder body having an internal fluid chamber, a piston configured to axially cycle within the cylinder body, an inlet valve in fluid communication with the fluid chamber;

an outlet valve in fluid communication with the fluid chamber;

a fixed annular seal positioned between the piston and the cylinder body;

a barrier fluid pocket formed in the cylinder body directly adjacent a high-pressure end of the annular seal;

a barrier fluid contained within the barrier fluid pocket, the barrier fluid being different from a pumped fluid; and a lattice structure positioned within the barrier fluid pocket, wherein the lattice structure extends axially from a first end to a second end thereof, the first end of the lattice structure abutting the high-pressure end of the annular seal, and wherein the lattice structure includes at least one barrier fluid pathway extending therethrough, wherein each of the barrier fluid pathways extends linearly and longitudinally through the lattice structure in a direction parallel to an axial direction of the piston, wherein a first end of each of the barrier fluid pathways faces towards the high-pressure end of the annular seal, wherein the first end of each of the barrier fluid pathways is formed at the first end of the lattice structure, wherein the barrier fluid is held within the lattice structure thereby providing a barrier preventing solids in the pumped fluid from contacting the high-pressure end of the annular seal, and wherein the barrier fluid pocket comprises a first portion having a constant cross-section containing the lattice structure and the barrier fluid pocket ending in a second portion tapering radially inward in a direction of the fluid chamber of the cylinder body.

7. The piston pump of claim 6, wherein the barrier fluid pocket faces in a direction of the fluid chamber of the cylinder body.

8. The piston pump of claim 6, wherein the lattice structure is an annular structure comprising a repeating series of geometric shapes having a constant cross-section from a first end to a second end of the lattice structure.

* * * * *